US010948199B2

(12) United States Patent
Scott

(10) Patent No.: US 10,948,199 B2
(45) Date of Patent: Mar. 16, 2021

(54) COOKTOP VENTILATION SYSTEM HAVING A DUAL DIRECTION FLOW BLOWER/FAN

(71) Applicants: BSH Home Appliances Corporation, Irvine, CA (US); BSH Hausgeräte GmbH, Munich (DE)

(72) Inventor: Sean Scott, Tulsa, OK (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 135 days.

(21) Appl. No.: 16/217,436

(22) Filed: Dec. 12, 2018

(65) Prior Publication Data

US 2020/0191409 A1 Jun. 18, 2020

(51) Int. Cl.
*F24C 15/20* (2006.01)

(52) U.S. Cl.
CPC ..... *F24C 15/2028* (2013.01); *F24C 15/2021* (2013.01); *F24C 15/2042* (2013.01)

(58) Field of Classification Search
CPC ..... F24C 15/2028
USPC ..... 126/299 D
See application file for complete search history.

(56) References Cited

U.S. PATENT DOCUMENTS 3,583,306 A * 6/1971 Hagdorn ..... F24F 9/00 126/299 D
4,450,756 A * 5/1984 Kling ..... F24C 15/2028 126/299 D
4,788,905 A * 12/1988 Von Kohorn ..... A47J 37/0781 126/25 R
6,058,929 A 5/2000 Fritz
6,173,710 B1 1/2001 Gibson et al.
6,620,038 B1 9/2003 Kikuchi et al.
6,851,421 B2 2/2005 Livchak et al.
7,699,051 B2 4/2010 Gagas et al.
2005/0163607 A1* 7/2005 Wang ..... F04D 29/282 415/98
2006/0150965 A1* 7/2006 Kim ..... F24C 15/2042 126/299 D
2008/0031735 A1* 2/2008 Chen ..... F03D 1/025 416/128

(Continued)

FOREIGN PATENT DOCUMENTS

CN 2396216 Y 11/1998
JP S56133547 A 10/1981

(Continued)

*Primary Examiner* — Avinash A Savani
(74) *Attorney, Agent, or Firm* — Michael E. Tschupp; Andre Pallapies; Brandon G. Braun

(57) ABSTRACT

A cooktop ventilation system for providing ventilation of a domestic cooking appliance, includes a domestic ventilation appliance including housing having at least a first opening and a second opening, the first opening for capturing exhaust air from the domestic cooking appliance and the second opening for permitting secondary air to exit an interior of the housing to form an air curtain that enhances a capture ability of the domestic ventilation appliance to capture the exhaust air, and a dual direction flow blower/fan configured both to convey the exhaust air through the housing from the first opening in a first direction and to convey the secondary air through the housing to the second opening in a second direction, the second direction being opposite the first direction.

19 Claims, 12 Drawing Sheets

100

(56) References Cited

U.S. PATENT DOCUMENTS

| | | | | |
|---|---|---|---|---|
| 2009/0211564 | A1* | 8/2009 | Pan | F24C 15/2028 126/299 D |
| 2011/0053483 | A1* | 3/2011 | Ritzer | F24C 15/2078 454/61 |
| 2013/0039766 | A1* | 2/2013 | Murikipudi | F04D 29/364 416/149 |
| 2015/0285524 | A1* | 10/2015 | Saunders | F24F 11/77 454/239 |

FOREIGN PATENT DOCUMENTS

| | | | |
|---|---|---|---|
| JP | S63251740 | A | 10/1988 |
| JP | H10288371 | A | 10/1998 |
| JP | 2003083584 | A | 3/2003 |
| KR | 20070116195 | A | 12/2007 |
| KR | 20100054769 | A | 5/2010 |
| KR | 20100056999 | A | 5/2010 |
| KR | 101034976 | B1 | 5/2011 |
| KR | 20130022576 | A | 3/2013 |
| WO | 0184054 | A1 | 11/2001 |

* cited by examiner

COOKTOP VENTILATION SYSTEM HAVING A DUAL DIRECTION FLOW BLOWER/FAN

CROSS-REFERENCES TO RELATED APPLICATION

This application is related to Applicants' co-pending U.S. application, which is filed concurrently herewith, entitled "COOKTOP VENTILATION SYSTEM HAVING A COMPLEX CURVE INTERIOR FLOW SURFACE," 16/217,429, which is incorporated herein by reference in its entirety.

FIELD OF THE INVENTION

The present invention is directed to a ventilation system for a domestic home appliance, and more particularly, to a domestic cooktop ventilation system providing an air curtain that enhances the capture ability of the ventilation device, the cooktop ventilation system having a dual direction flow blower/fan.

BACKGROUND OF THE INVENTION

Some modern domestic kitchens include an appliance, such as a cooking range or cooktop, that has an electric or gas heat source such as an inductive, electric, or gas cooktop, a griddle, an internal heat source such as an oven or warming drawer, or other feature that requires ventilation. Various types of ventilation appliances have been provided for ventilating or filtering air in a kitchen, such as a traditional wall ventilation hood, a chimney ventilation hood, or an island ventilation hood.

SUMMARY OF THE INVENTION

The present invention is directed to a cooktop ventilation appliance, or system, that provides an air curtain that enhances the capture ability of the ventilation appliance or system, and includes a dual direction flow blower/fan, which improves air flow efficiency and operation of the ventilation appliance and reduces airflow noise while providing a compact configuration.

The present invention recognizes that, among other factors, the size, shape, and distance of the opening of a housing of a ventilation appliance or system affects the ability of the ventilation appliance or system to capture exhaust air (e.g., hot air, flue gases, contaminated air, etc.) from an appliance that requires ventilation, such as a cooking range or cooktop, that has an electric or gas heat source such as an inductive, electric, or gas cooktop, a griddle, an internal heat source such as an oven or warming drawer, or other feature that requires ventilation. To solve these and other problems, the present invention provides an air curtain flowing from the housing of a cooktop ventilation appliance or system, such that the air curtain provides a virtual extension of the housing of the hood or ventilation capture system (e.g., away from the hood or ventilation capture system and toward or around the kitchen appliance needing ventilation), which enhances the capture ability of the ventilation appliance or system. The air curtain can be formed around a part of, or all of, a perimeter of a region where exhaust air is to be captured.

The air curtain can be formed by an airflow of secondary air, such as cool air, outside air, etc. (i.e., non-exhaust air), that is supplied to the ventilation appliance from either a specific blower, make-up blower, or other air flow source. In one example, the appliance can be configured to use, or supply, make-up air to form the air curtain, thereby supplying a quantity of make-up air into the kitchen environment to replace the exhaust air being drawn into and exhausted from the kitchen by the ventilation appliance while using the make-up air in a functional manner to provide a virtual extension to the end of the hood or ventilation capture system that will enhance capture ability of the ventilation device. Exemplary embodiments of the invention can be configured to be used with or without make-up air. The air curtain can be directed through one or more air channels or cavities of a housing of the cooktop ventilation appliance or system towards the front, sides, rear, and/or perimeter of the housing from either a specific blower, make-up blower, or other air flow source and that flows from one or more openings, slots, or ports at the front, sides, rear, and/or perimeter of the housing. The air curtain will provide a virtual extension to the end of the hood or ventilation capture system that can enhance capture ability of the ventilation device, thereby improving the capture of, and increasing the efficiency of the capture of smoke, grease, air (aroma), flue gases, contaminated air, etc. from an appliance that requires ventilation, such as a cooking range or cooktop, that has an electric or gas heat source such as an inductive, electric, or gas cooktop, a griddle, an internal heat source such as an oven or warming drawer, or other feature that requires ventilation.

The present invention further recognizes that such an airflow being directed through one or more air channels or cavities of the housing of the cooktop ventilation appliance towards the front, sides, rear, and/or perimeter of the housing during operation of the ventilation appliance can result in increased levels of noise (e.g. flow induced noise). The interior of a ventilation appliance typically is very rough or irregular with many cavities that can capture and redirect the air flow as well as provide cavitation points for the air flow, each of which can cause noise. Some conventional solutions for addressing noise rely on insulation and damping materials. However, these conventional techniques do not address issues of flow induced noise concerns. To solve these and other problems, the present invention can provide a cooktop ventilation system, for example, with a complex curve interior flow surface that can provide sound insulation and sound deadening, while at the same time directing, guiding, and/or smoothing out the air flow as it flows through the ventilation appliance towards the front, sides, rear, and/or perimeter of the housing and exits from one or more openings, slots, or ports at the front, sides, rear, and/or perimeter of the housing of the ventilation appliance, thereby reducing cavitation and noise levels, including flow induced noise, while also providing a compact arrangement.

Additionally, the present invention recognizes that an additional air flow source is needed to provide both an airflow for conveying exhaust air and another airflow for conveying secondary air through the ventilation appliance in order to form an air curtain, and if a complex curve interior flow surface is provided, for conveying secondary air through one or more channels formed in the interior of the housing of the ventilation appliance. Some conventional solutions for providing multiple air flows rely on a secondary fan or damper system, which may increase costs, result in additional noise, and require additional space and ducting etc. To solve these and other problems, the present invention provides a cooktop ventilation system with a dual direction flow blower/fan for providing a bi-directional air flow to a cooktop ventilation system, and which improves air flow efficiency and operation of the ventilation appliance and reduces airflow noise while providing a compact configuration. Additionally, the present invention provides a dual direction flow blower/fan that is particularly advantageous for providing a bi-directional air flow to a cooktop ventilation system having a complex curve interior flow surface that provides sound insulation and sound deadening, while at the same time directing, guiding, and/or smoothing out the air flow as it flows through the ventilation appliance towards the front, sides, rear, and/or perimeter of the housing and exits from one or more openings, slots, or ports at the front, sides, rear, and/or perimeter of the housing of the ventilation appliance, thereby reducing cavitation and noise levels, including flow induced noise, while also providing a compact arrangement.

In an example, a cooktop ventilation system includes a dual direction flow blower/fan, such as a bi-directional axial flow fan, with an inner fan section and outer fan section that provide airflow in opposite directions, but which are driven by the same fan shaft. In this way, the dual direction flow blower/fan can provide both an exhaust fan and a secondary air blower/fan (e.g., make-up air blower/fan) in a single fan/blower unit, thereby eliminating a need for a secondary blower/fan, which may reduce costs and blower/fan noise, while improving air flow efficiency and compactness of the appliance or system. An example fan impeller can include two impeller sections, such as an inner impeller section and an outer impeller section. The two impeller sections can be configured (e.g., shaped, angled, etc.) to provide bi-directional flow, while rotating in the same direction, where one impeller section provides air flow in a first direction and another impeller section provides air flow in a second, opposite direction. In this way, the exemplary dual direction flow blower/fan can provide both exhaust air flow and secondary air flow (e.g., make up air flow, outside air flow, cool air, etc.) using a single blower/fan, a single fan motor, and a single fan assembly/housing.

Additionally, the exemplary embodiments of a dual direction flow blower/fan having a bi-directional axial flow fan enable both exhaust air flow and secondary air flow (e.g., make up air flow, outside air flow, cool air, etc.) to be conveyed, for example, through a bi-directional duct having concentric or nested flow paths using a single blower/fan, a single fan motor, and a single fan assembly/housing and with a compact and efficient arrangement. The exemplary embodiments of a dual direction flow blower/fan also enable both exhaust air flow and secondary air flow (e.g., make up air flow, outside air flow, cool air, etc.) to be conveyed through an opening (e.g., a single opening) in a housing of a ventilation appliance, with one air flow (e.g., exhaust air) being conveyed to flow through an opening in a complex curve interior flow surface to one side of the complex curve interior flow surface, and another air flow (e.g., secondary air) to be conveyed onto another side of the complex curve interior flow surface. In this example of a ventilation appliance or system, such a complex curve interior flow surface forms a dividing wall or partition between a flow of cool air (secondary air) used to form an air curtain extending/flowing from one or more perimeter side sections of the appliance, and a flow of exhaust air captured by the ventilation appliance and being exhausted from the kitchen. One side of the complex curve interior flow surface guides the flow of the secondary air flow (e.g., make up air flow, outside air flow, cool air, etc.) conveyed by the dual direction flow blower/fan in a direction into the housing to be used to form the air curtain, while another, opposite side of the complex curve interior flow surface guides the flow of the exhaust air flow conveyed by the dual direction flow blower/fan, in an opposite direction, from the housing of the ventilation appliance.

In some examples, the ventilation appliance can include a dual direction flow blower/fan that is integrated into a duct (e.g., bi-directional duct) in an in-line arrangement with the duct and/or internal components of the ventilation appliance, thereby providing a compact and efficient airflow arrangement for conveying the one or more air flows (e.g., exhaust air, secondary air) through the housing of the ventilation appliance. In other examples, the dual direction flow blower/fan and/or duct, can be angled with respect to the housing of the ventilation appliance (e.g., with respect to an axis of an opening of the housing through which the one or more air flows, e.g., exhaust air, secondary air, are conveyed). In other examples, the dual direction flow blower/fan can be arranged within the housing of the ventilation appliance, thereby further improving the compact and efficient airflow arrangement for conveying one or more air flows (e.g., exhaust air, secondary air) through the housing of the ventilation appliance. In other examples, the dual direction flow blower/fan can be arranged in other locations, such as being located remotely from the ventilation appliance, for example, in an adjacent duct or other secondary air source, such as an exterior cap system.

Exemplary embodiments of the dual direction flow blower/fan, as well as other components such as a bi-directional duct, complex curve interior flow surface, etc., according to the invention can be provided in various types of ventilation appliances, such as a traditional wall hood, a chimney wall hood, or an island hood.

For purposes of this disclosure, the term exhaust air refers to, for example, one or more of hot air, flue gases, contaminated air, etc. from an appliance that requires ventilation, such as a cooking range or cooktop, that has an electric or gas heat source such as an inductive, electric, or gas cooktop, a griddle, an internal heat source such as an oven or warming drawer, or other feature that requires ventilation. The term secondary air refers to non-exhaust air including, for example, one or more of cool air, outside air, make-up air, etc. that is supplied to the ventilation appliance, for example, from either a specific blower, make-up blower, or other air flow source.

An exemplary embodiment of the present invention addresses and solves the above-recognized problems and others by providing a cooktop ventilation system for providing ventilation of a domestic cooking appliance, including a domestic ventilation appliance with a housing having a first opening for capturing exhaust air from the domestic cooking appliance and a second opening for permitting the secondary air to exit the housing to form an air curtain that enhances a capture ability of the domestic ventilation appliance, and a dual direction flow blower/fan configured to convey both the secondary air into the interior of the housing in a first direction and the exhaust air from the housing in a second direction that is opposite the first direction.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
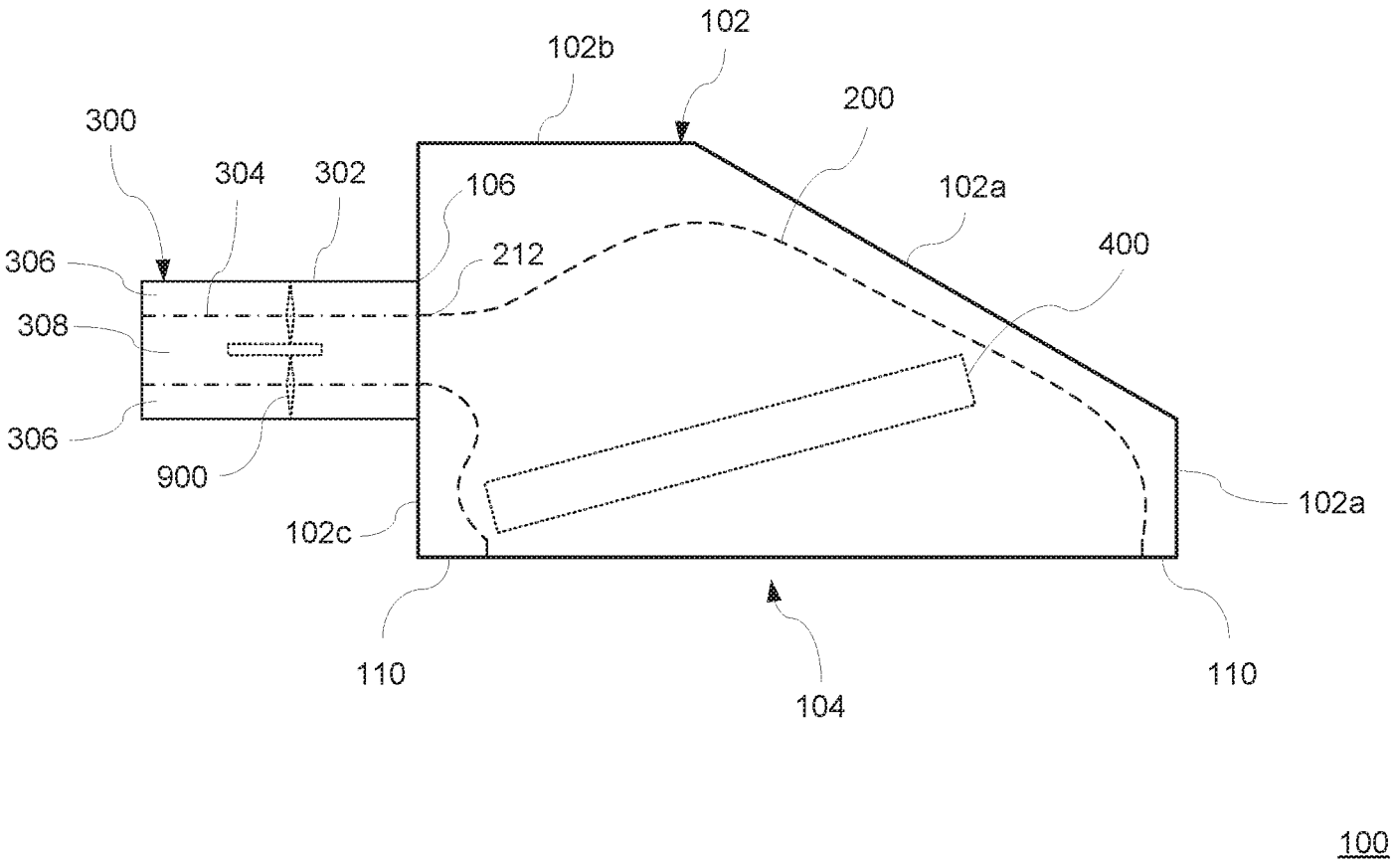
FIG. 1 is a schematic side view of a cooktop ventilation appliance or system according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

FIGS. 1-12 schematically show examples of a cooktop ventilation appliance or system 100 having a dual direction flow blower/fan 900 for generating movement of one or more air flows according to features of the invention.

With reference to FIGS. 1-6, an example cooktop ventilation appliance or system 100 has a housing 102 including a front wall 102*a*, a top wall 102*b*, a rear wall 102*c*, a first side wall 102*d*, and a second side wall 102*e*. A lower wall of the housing 102 can include a first opening 104 for drawing exhaust air A10 (e.g., hot air, flue gases, contaminated air, etc.) into the ventilation appliance 100 from a domestic home cooking appliance that requires ventilation, or the walls 102*a*, 102*c*, 102*d*, and 102*e* of the housing 102 can define the first opening 104. The ventilation appliance 100 can be coupled to a duct 300 (e.g., a bi-directional duct) for conveying one or more air flows (e.g., exhaust air A10, secondary air A20) through the housing 102 of the ventilation appliance 100. In this example, the ventilation appliance 100 includes a dual direction flow blower/fan 900 for generating movement of the one or more air flows (e.g., exhaust air A10, secondary air A20). In this example, the dual direction flow blower/fan 900 is integrated into the duct 300 (e.g., bi-directional duct) in an in-line arrangement with the duct 300 and internal components of the ventilation appliance 100, thereby providing a compact and efficient airflow arrangement for conveying the one or more air flows (e.g., exhaust air A10, secondary air A20) through the housing 102 of the ventilation appliance 100. In other examples, the air flow source, including the dual direction flow blower/fan 900 and/or duct 300, can be angled with respect to the housing 102 of the ventilation appliance 100 (e.g., with respect to an axis of an opening 106 of the housing 102 through which the one or more air flows, e.g., exhaust air A10, secondary air A20, are conveyed). In other examples, the dual direction flow blower/fan 900 can be arranged within the housing 102 of the ventilation appliance 100, thereby further improving the compact and efficient airflow arrangement for conveying one or more air flows (e.g., exhaust air A10, secondary air A20) through the housing 102 of the ventilation appliance 100. In other examples, the dual direction flow blower/fan 900 can be arranged in other locations, such as being located remotely from the ventilation appliance 100, for example, in an adjacent duct or other secondary air source, such as an exterior cap system.

As shown in FIGS. 1-6, the housing 102 can include one or more first openings 104 (e.g., air capture inlet) in the lower wall of the housing 102 for drawing exhaust air A10 into the housing 102, one or more second openings 106 for permitting secondary air A20 to enter the housing 102 and/or exhaust air A10 to exit from the housing 102, and one or more second openings 110 (e.g., outlet) for directing secondary air A20 out of the housing 102 to form an air curtain. The ventilation appliance 100 can include one or more air filters and/or grease filters 400 for filtering the exhaust air A10 as it flows through the ventilation appliance 100. In the examples, the secondary air A20 can be supplied to the housing 102, for example, by air flow path 306 through a bi-directional duct 300, and the exhaust air A10 can be exhausted from the housing 102, for example, by air flow path 308 through the bi-directional duct 300. The opening or outlet 110 can include one or more outlets (e.g., one or more slots, gaps, openings, elongated openings, etc.) formed in a surface of a lower wall of the housing 102. Additionally or alternatively, the one or more openings or outlets 110 can include one or more outlets (e.g., one or more slots, gaps, openings, elongated openings, etc.) extending along all or a part of a perimeter wall (e.g., 102*a*, 102*c*, 102*d*, 102*e*) of the housing. The one or more openings or outlets 110 can be configured to form an air curtain exiting from one or more of the front, sides, rear, and/or all or part of the perimeter of the housing 102 during operation of the ventilation appliance 100, as shown in FIG. 2B. The ventilation appliance 100 can include, for example, a complex curve interior flow surface 200 disposed within the housing 102 that guides the secondary air A20 through the housing 102 where the air A20 is directed from one or more second openings or outlets 110 to form an air curtain. The secondary air A20 generally is directed from the one or more second openings or outlets 110 in a direction that is opposite to a direction of flow of the exhaust air A10.

In the examples shown in FIGS. 1-6, a complex curve interior flow surface 200 forms a dividing wall or partition between a flow of the secondary air A20 (e.g., make-up air, cool air, etc.) used to form the air curtain and a flow of the exhaust air A10 captured by the ventilation appliance 100. In the examples, one side of the complex curve interior flow surface 200 guides the flow of the secondary air A20 from the flow path 306 of the bi-directional duct 300 to the one or more openings, slots, or ports 110 at the front, sides, rear, and/or perimeter of the housing 102 to form an air curtain, while another, opposite side of the complex curve interior flow surface 200 guides the flow of the exhaust air A10 captured by the ventilation appliance 100 from the air capture region (opening 104) of the housing 102 to the flow path 308 of the bi-directional duct 300 for conveying the exhaust air A10 from the kitchen. In the example shown in FIG. 2B, a direction of flow of the secondary air A20 on one side of the complex curve interior flow surface 200 is opposite to a direction of flow of the exhaust air A10 on the other side of the complex curve interior flow surface 200. In the examples, the complex curve interior flow surface 200 cooperates with the housing 102 to form a flow path 108 that smoothly and efficiently guides the flow of the secondary air A20 from the flow path 306 of the bi-directional duct 300 to the one or more openings, slots, or ports 110 at the front, sides, rear, and/or perimeter of the housing 102. In other examples, other arrangements can be provided for guiding the secondary air A20 and/or exhaust air A10.

Figure 2A:
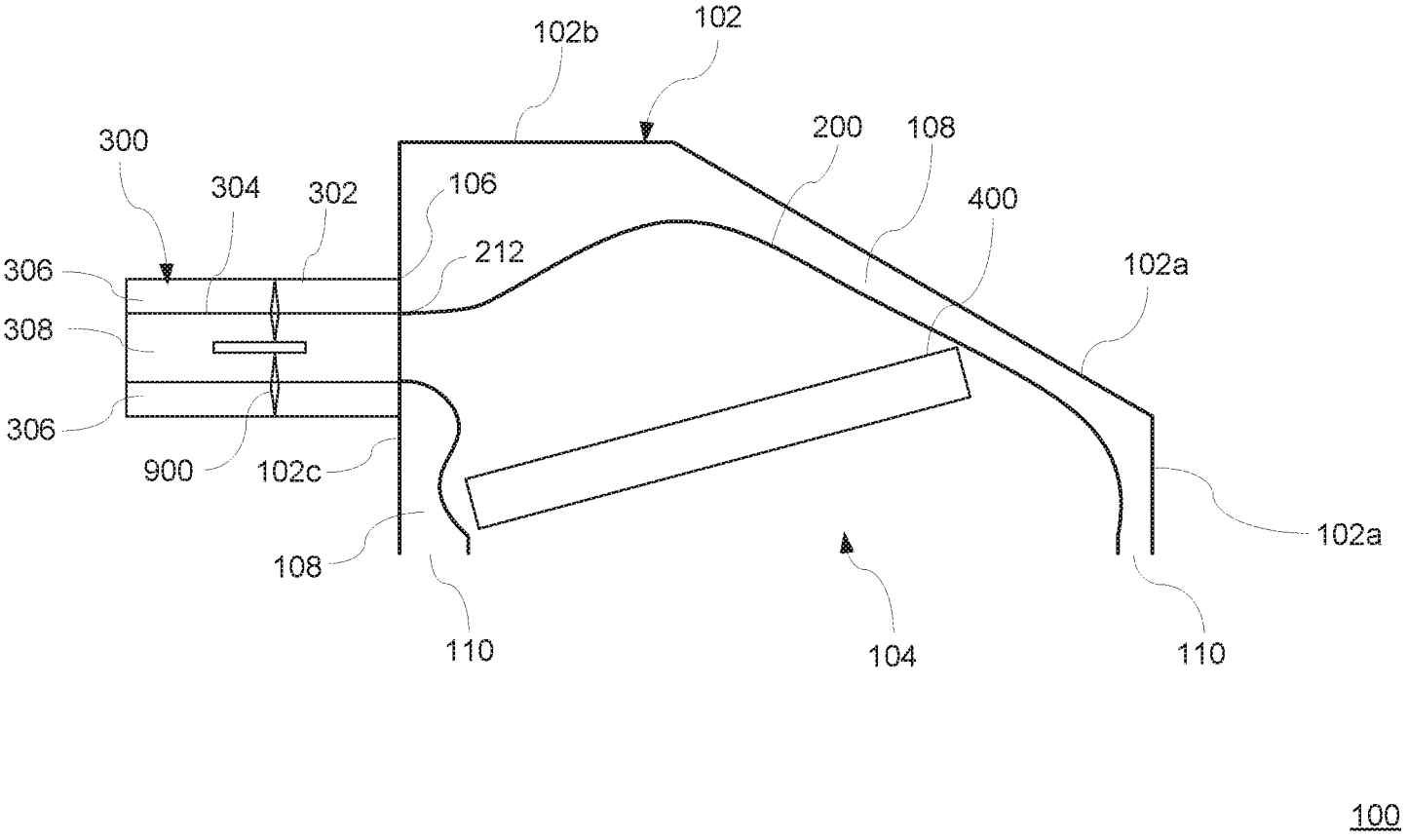
FIG. 2A is a cutaway view of the cooktop ventilation appliance or system according to the exemplary embodiment schematically illustrated in FIG. 1.
Figure 2B:
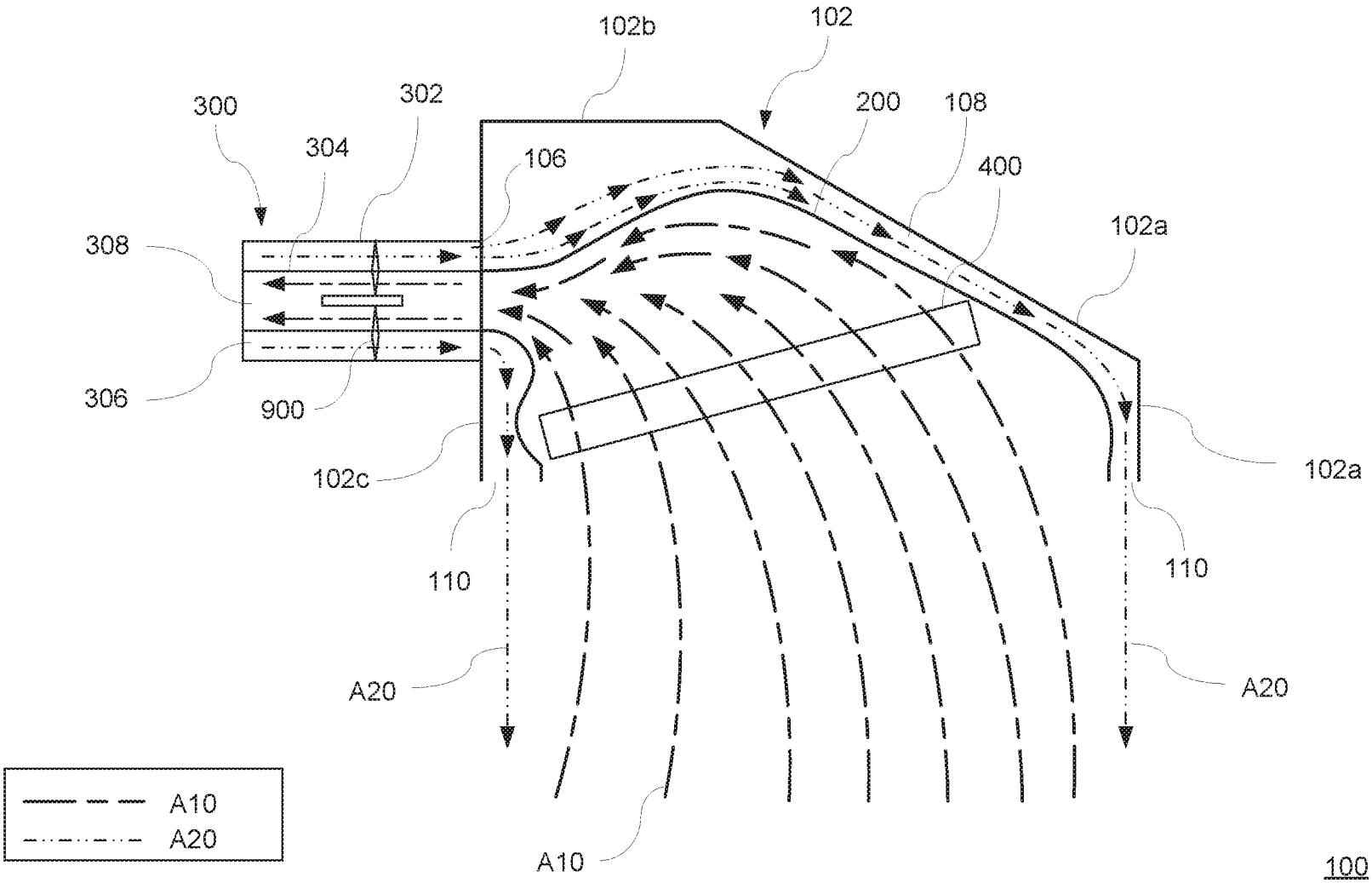
FIG. 2B is the cutaway view of the cooktop ventilation appliance or system illustrated in FIG. 1 showing air flow examples.
Figure 3:
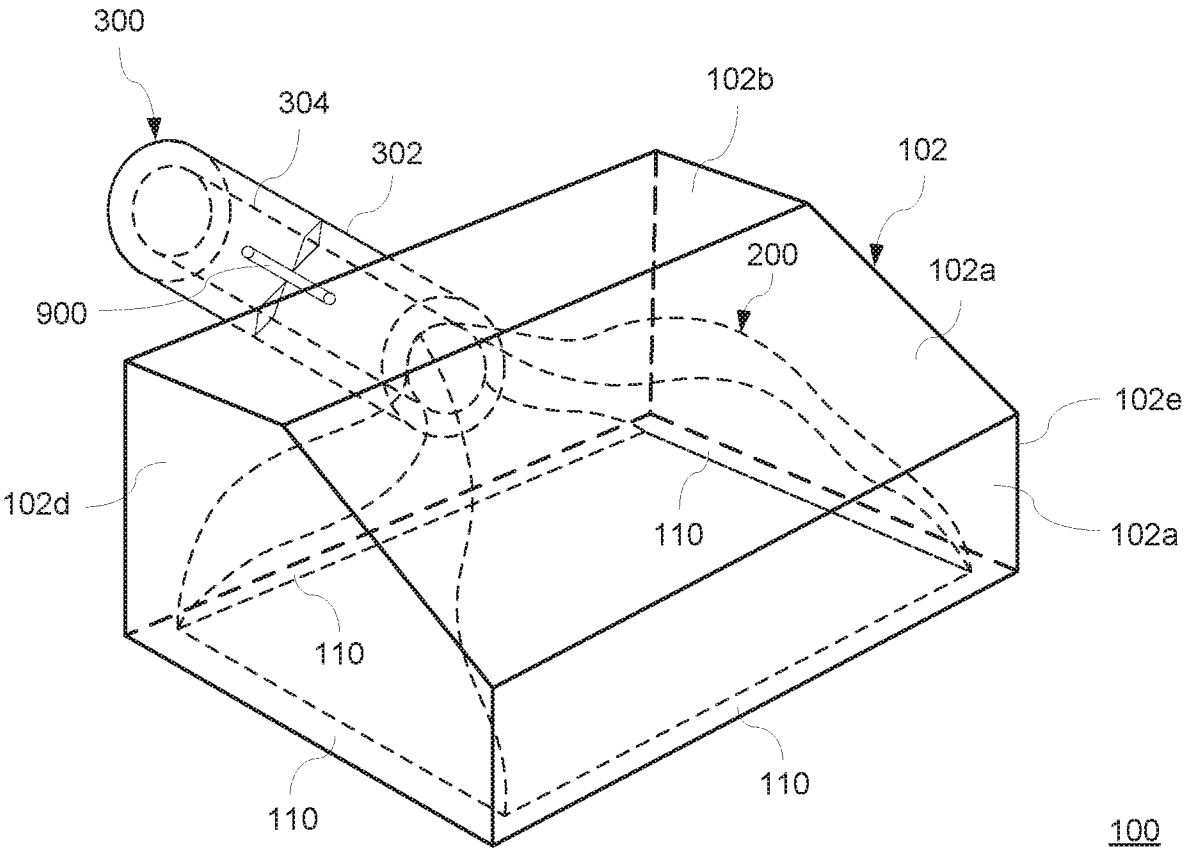
FIG. 3 is a schematic perspective view of a cooktop ventilation appliance or system according to an exemplary embodiment of the invention.
Figure 4:
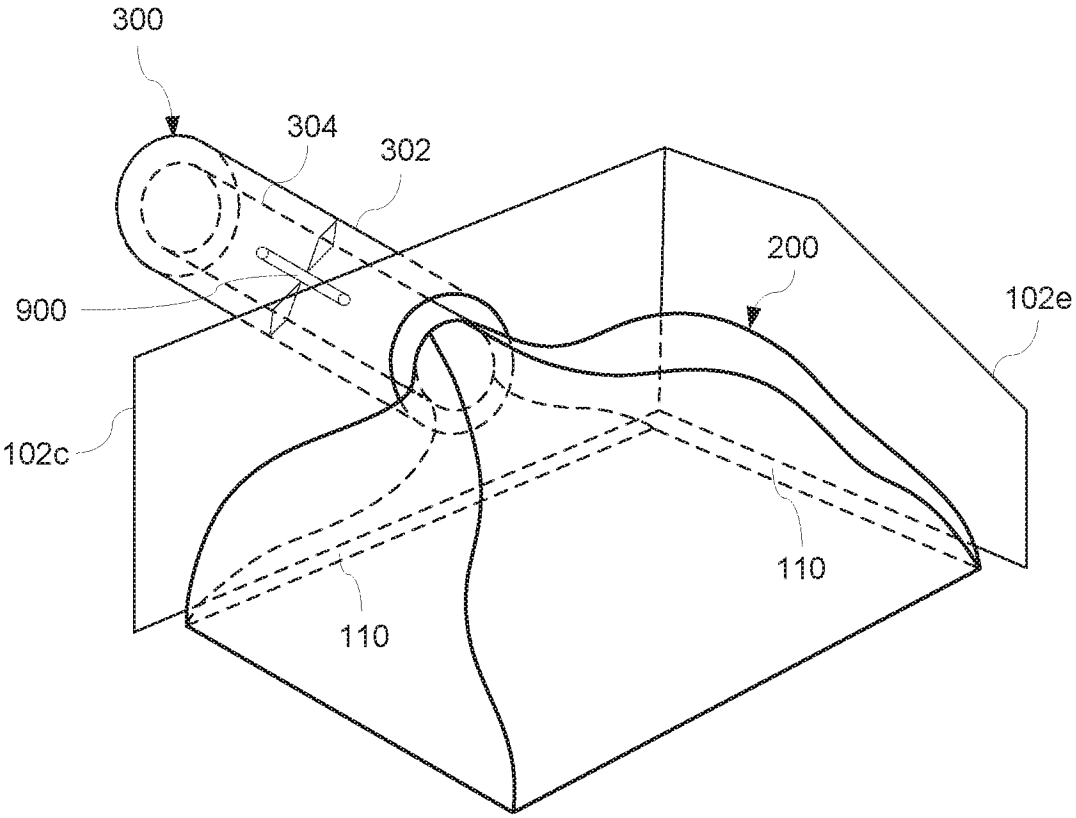
FIG. 4 is a cutaway view of the cooktop ventilation appliance or system according to the exemplary embodiment schematically illustrated in FIG. 3 with parts of the housing removed to show interior components.
Figure 5:
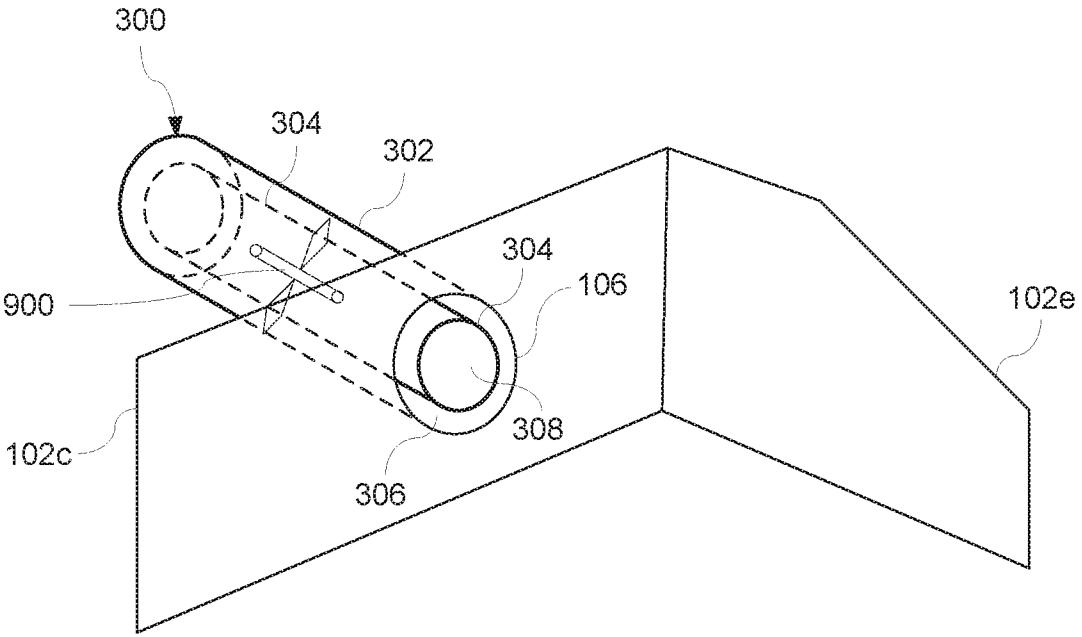
FIG. 5 is another cutaway view of the cooktop ventilation appliance or system according to the exemplary embodiment schematically illustrated in FIG. 3 with parts removed to show interior components.
Figure 6:
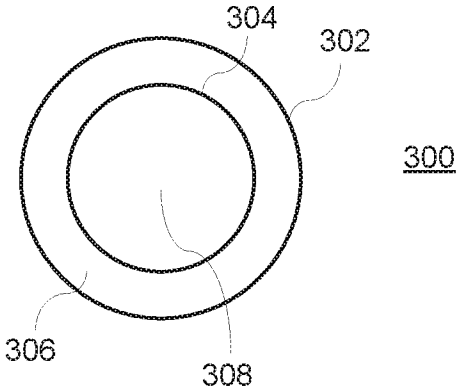
FIG. 6 is a schematic cross-sectional view of a duct of the cooktop ventilation appliance or system according to the exemplary embodiment.

For simplicity, FIG. 2B generally shows the air flow A20 and A10 using dashed lines. One of ordinary skill will recognize that, in operation, one or more sections or portions of the complex curve interior flow surface 200 can direct, guide, or change a direction of the air flow A20 and/or A10 within the flow cavities or channels, and at different locations along the flow path within the flow cavities or channels, such that the air flow A20 and/or A10 flows adjacent to or along the surfaces of the complex curve interior flow surface 200 (e.g., in a path corresponding, at least in part, to a shape of one or more surfaces of the complex curve interior flow surface 200).

As shown in FIGS. 1-6, an example of a duct 300 (e.g., bi-directional duct) can include an outer wall 302 and an inner wall 304, which define a first flow path 308 through the duct 300 for conveying exhaust air A10 that is drawn into the housing 102, and a second flow path 306 through the duct 300 for conveying secondary air A20 (e.g., make-up air) into the housing 102 and conveyed by the flow path (e.g., channel or cavity 108) to an outlet 110 for forming an air curtain exiting or extending from the housing 102. The outer wall 302 and inner wall 304 are shown in the example as being concentric or nested cylinders forming the flow paths, thereby providing a compact and efficient means for conveying the air A20 into the housing and the exhaust air A10 out of the housing. The arrangement of the duct 300 is not limited to any particular arrangement. In other examples, the outer wall 302 and an inner wall 304 can have other shapes, such as a square shape or rectangular shape nested within each other. As shown in the example illustrated in FIG. 5, the outer wall 302 can be coupled to the opening 106 of the wall 102*c* of the housing 102 such that both flow paths 306 and 308 are in communication with the interior of the housing 102 through the same opening 106. As shown in the examples illustrated in FIGS. 1-6, the inner wall 304 can be coupled to the opening 212 of a complex curve interior flow surface 200, or the like, such that the flow path 308 is in communication with the air capture opening 104 of the housing 102 using the same opening 106 in the housing 102. In this example, the complex curve interior flow surface 200 includes a body 202 defining a cavity (e.g., a hollow body or shell) in communication with the air capture opening 104 of the housing 102. The complex curve interior flow surface 200 includes an opening 212 configured to be coupled to the inner wall 304 of the duct 300 for directing or guiding exhaust air A10 from the cavity within the body into the flow path 308 of the duct 300. At the same time, the secondary air A20 can flow from the flow path 306 of the duct 300, which is defined by the outer wall 302 and the inner wall 304, through the opening 106 in the wall 102*c* of the housing 102 over the exterior of the complex curve interior flow surface 200. The body of the complex curve interior flow surface 200 can include a plurality of sections configured to direct or guide the secondary air A20 (e.g., cool air, make-up air, etc.) over the outer surface of the body 202 to other regions within the interior of the housing 102, such as along the rear and/or sides of the complex curve interior flow surface 200 and correspondingly to the one or more openings or outlets 110 along the perimeter of walls 102*c*, 102*d*, 102*e* to form an air curtain. An interior surface of the body of the complex curve interior flow surface 200 also can include a plurality of sections configured to direct or guide the exhaust air A10 through the cavity to the opening 212.

In the examples shown in FIGS. 1-6, a dual direction flow blower/fan 900 is integrated into the duct 300 (e.g., bi-directional duct) in an in-line arrangement with the bi-directional duct 300 and with respect to an axis of the opening 106 of the housing 102 and the opening 212 of the complex curve interior flow surface 200. As shown in the example in FIG. 2B, the dual direction flow blower/fan 900 is configured to convey exhaust air A10 into the housing 102 through the air capture opening 104, through one or more filters 400 (e.g., air filters, grease filters, etc.), along the flow path defined, for example, by the complex curve interior flow surface 200, through the opening 212 in the complex curve interior flow surface 200 and the opening 106 in the wall 102*c* of the housing 102, and along the first flow path 308 through the duct 300, for exhausting the exhaust air A10 to the outside. At the same time, the dual direction flow blower/fan 900 is configured to convey secondary air A20 (e.g., make-up air, outside air, cool air, etc.) along the second flow path 306 through the duct 300, through the opening 106 in the wall 102*c* of the housing 102, and into the housing 102, where the secondary air A20 can be directed or guided along one or more air flow paths 108 defined, for example, by the complex curve interior flow surface 200, to the one or more slots, openings, exit ports, vents, louvers, or the like (e.g., 110) for forming an air curtain exiting or extending from the housing 102.

In this example, the outer wall 302 and inner wall 304 of the duct 300 are concentric or nested cylinders forming the flow paths 306 and 308, and the dual direction flow blower/fan 900 is axially arranged with respect to the duct 300, thereby generating the air flows A10 and A20 along the air flow paths 306, 308 defined by the concentric or nested cylinders and providing a compact and efficient means for conveying the one or more air flows (e.g., exhaust air A10, secondary air A20) through the housing 102 of the ventilation appliance 100. In other examples, the dual direction flow blower/fan 900 and/or duct 300, can be angled with respect to the housing 102 of the ventilation appliance 100 (e.g., with respect to an axis of the opening 106 of the housing 102 and/or the opening 212 in the complex curve interior flow surface 200 or the like, through which the one or more air flows, e.g., exhaust air A10, secondary air A20, are conveyed.

Figure 7B:
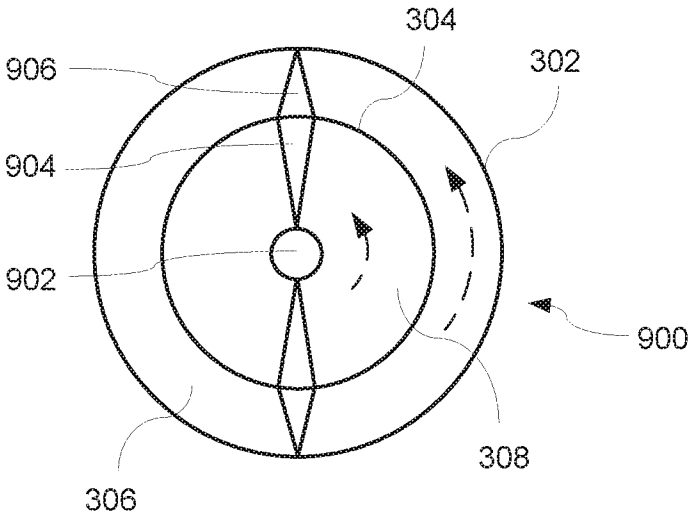
FIG. 7B is a schematic front view of a dual direction blower/fan according to the exemplary embodiment of the cooktop ventilation appliance or system illustrated in FIG. 7A.
Figure 7A:
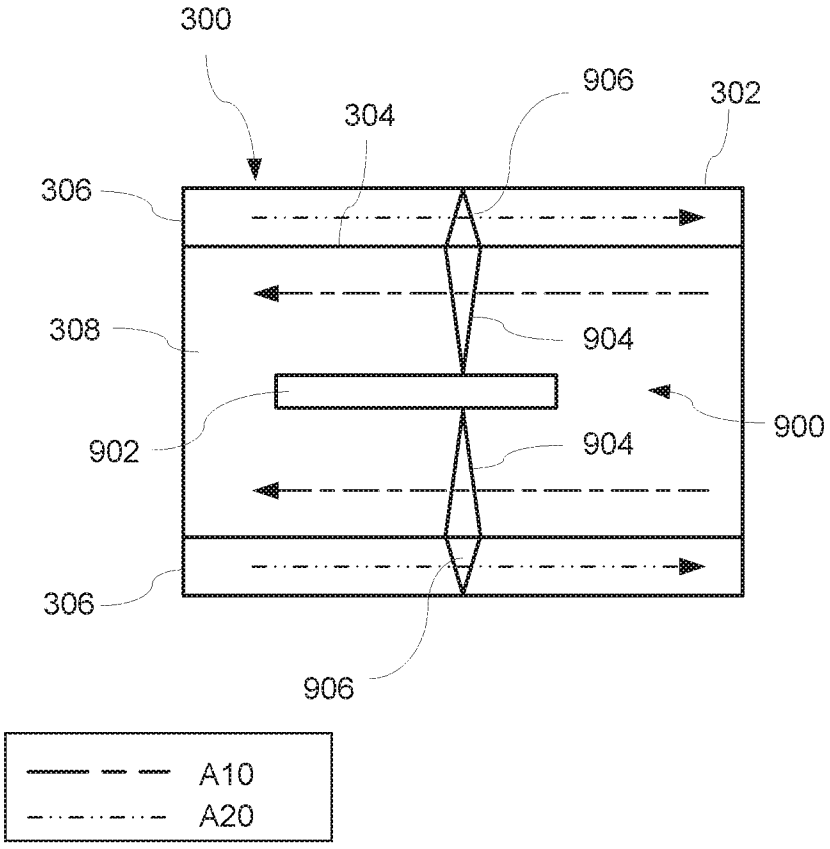
FIG. 7A is a schematic cross-sectional view of a dual direction blower/fan of a cooktop ventilation appliance or system according to the exemplary embodiment.

FIGS. 7A and 7B schematically show an example of a dual direction flow blower/fan 900. As shown in this example, a dual direction flow blower/fan 900 can include a bi-directional axial flow fan having a fan shaft 902, an inner fan section 904, and an outer fan section 906. The inner fan section 904 and the outer fan section 906 are coupled to and coaxially arranged with the fan shaft 902, such that rotation of the shaft 902 simultaneously drives the inner fan section 904 and the outer fan section 906 (e.g., in the same direction). Each of the inner fan section 904 and the outer fan section 906 includes, for example, one or more fan impellers for conveying air. The one or more fan impellers of the inner fan section 904 are configured to convey air (e.g., exhaust air A10) in a first direction and the one or more fan impellers of the outer fan section 906 are configured to convey air (e.g., secondary air A20) in a second direction that is opposite to the first direction. The one or more fan impellers of the inner fan section 904 and the outer fan section 906 can be configured respectively to have one or more of an angle, shape, size, etc. to produce the desired air flow direction, as well as the desired air flow volume, speed, etc. for the particular ventilation appliance 100.

The dual direction flow blower/fan 900, which is capable of providing bi-directional air flow, is not limited to any particular arrangement. As shown in the schematic example in FIGS. 7A and 7B, the inner fan section 904 and the outer fan section 906 can be coupled to and coaxially arranged with the fan shaft 902, such that rotation of the shaft 902 simultaneously drives the inner fan section 904 and the outer fan section 906. The inner fan section 904 and the outer fan section 906 can be rotatable in a void, channel, slot, or the like, formed in the inner wall 304 of the duct 300 or similar fan casing such that the inner fan section 904 and the outer fan section 906 are rotatable within the duct 300 or similar fan casing. The one or more fan impellers of the inner fan section 904 and the outer fan section 906 can be configured respectively to have one or more of an angle, shape, size, etc. to produce the desired air flow direction, as well as the desired air flow volume, speed, etc. of each air flow for a particular configuration of a ventilation appliance or system 100 and/or for a particular configuration of a bi-directional duct or air flow arrangement, etc.

Figure 8B:
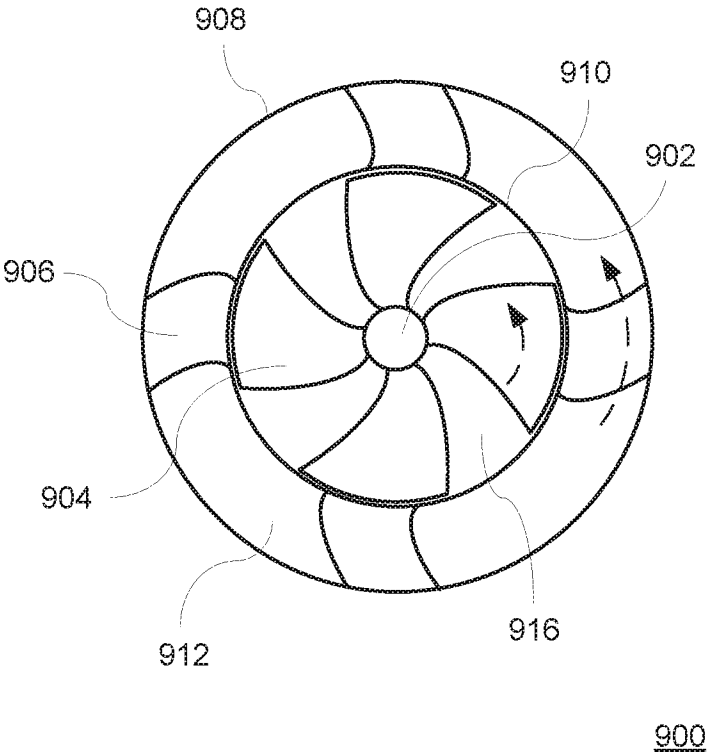
FIG. 8B is a schematic front view of a dual direction blower/fan according to the exemplary embodiment of the cooktop ventilation appliance or system illustrated in FIG. 8A.
Figure 8A:
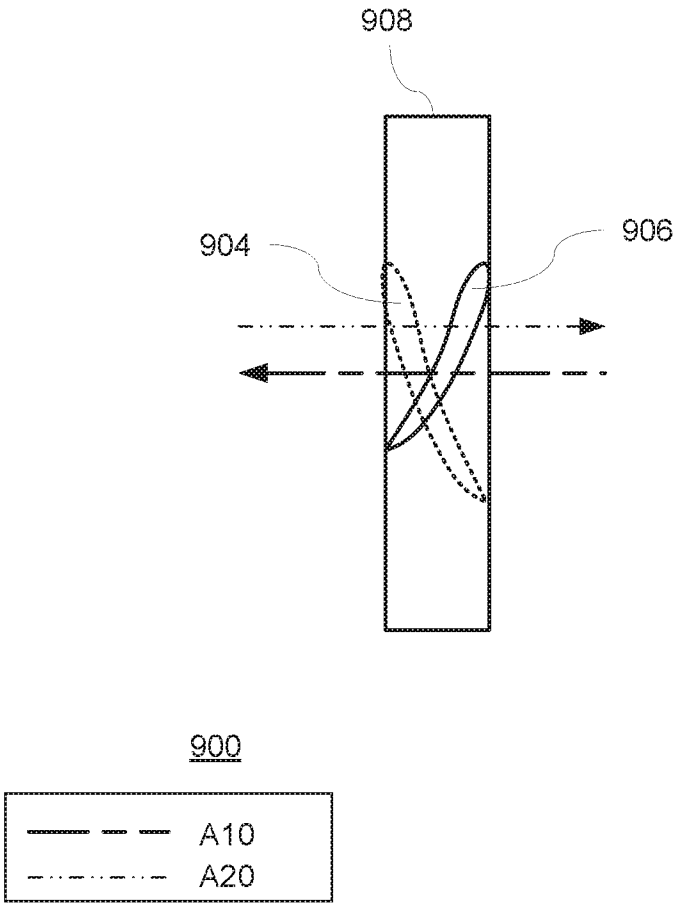
FIG. 8A is a schematic cross-sectional view of a dual direction blower/fan of a cooktop ventilation appliance or system according to the exemplary embodiment.

As shown in the example illustrated in FIGS. 8A and 8B, the inner fan section 904 and the outer fan section 906 can be coupled to and coaxially arranged with the fan shaft 902, such that rotation of the shaft 902 simultaneously drives the inner fan section 904 and the outer fan section 906. The one or more fan impellers of inner fan section 904 can be coupled between, for example, the fan shaft 902 (or a part coupled to the fan shaft 902) and an inner ring 910, and the one or more fan impellers of the outer fan section 906 can be coupled between, for example, the inner ring 910 and an outer ring 908. The inner ring 910 can be configured to define a portion of the air flow path A20 being generated by the inner fan section 904, and to partition, divide, or separate the air flow paths A10 and A20 being generated by the respective inner fan section 904 and the outer fan section 906. The outer ring 908 and the inner ring 910 can be configured to define a portion of the air flow path A10 being generated by the outer fan section 906. The components (e.g., 902, 904, 904, 908, 910) of the dual direction flow blower/fan 900 can be integrally formed or assembled from separate components. The dual direction flow blower/fan 900 can include a fan housing (not shown) encasing the components (e.g., 902, 904, 904, 908, 910) of the dual direction flow blower/fan 900, along with one or more other components such as a blower motor, power connections, control systems, etc.

As shown in the example in FIG. 8A, the one or more fan impellers 904, 906, as well as the inner and outer rings 910, 908 of the inner fan section 904 and the outer fan section 906, can be configured respectively to have one or more of an angle, shape, size, etc. to produce the desired air flow direction, as well as the desired air flow volume, speed, etc. of each air flow for a particular ventilation appliance 100 and/or for a particular bi-directional duct or air flow arrangement. Other components such as a blower motor, power connections, control systems, etc. can be provided to produce the desired air flow direction, as well as the desired air flow volume, speed, etc. of each air flow for a particular ventilation appliance 100 and/or for a particular bi-directional duct or air flow arrangement.

In the examples shown in FIGS. 7A and 7B, and FIGS. 8A and 8B, the dual direction flow blower/fan 900 is integrally formed with the duct 300 and is disposed within the inner and outer walls 302 and 304 of the duct 300. In other examples, the dual direction flow blower/fan 900 can be a separate component that can be coupled to an end of a duct 300 or the like, or inserted between two sections of a duct 300 or the like. In such other examples, the dual direction flow blower/fan 900 can include an outer fan casing or wall configured to be coupled to, for example, a duct 300 or the like, the outside of the opening 106 of the wall 102*c* of the housing 102 of the ventilation appliance 100, the inside of the opening 106 of the wall 102*c* of the housing 102 of the ventilation appliance 100, the opening 212 in the complex curve interior flow surface 200 or the like, another duct or internal component defining a flow path within the housing 102 of the ventilation appliance 100, or another external source of the secondary air, etc.

Figure 9:
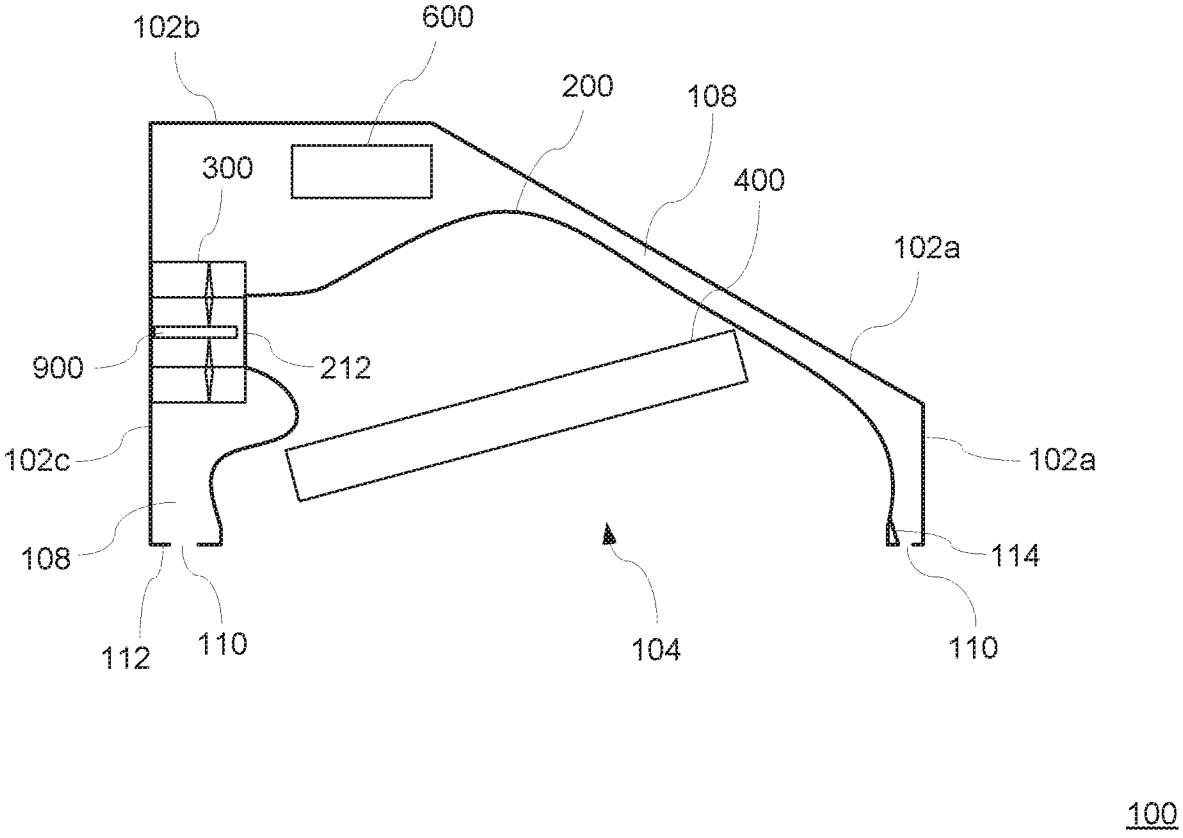
FIG. 9 is a schematic cutaway view of the cooktop ventilation appliance or system according to other exemplary embodiments.

FIG. 9 illustrates an example of a ventilation appliance 100 in which a dual direction flow blower/fan 900 is arranged inside the housing 102 of the ventilation appliance 100. In this example, the dual direction flow blower/fan 900 is integrally formed with a duct 300 and is disposed within the inner and outer walls 302 and 304 of the duct 300. The dual direction flow blower/fan 900 is disposed on an interior side of the wall 102*c* of the housing 102, and between the opening 106 of the wall 102*c* and the opening 212 of the complex curve interior flow surface 200. The dual direction flow blower/fan 900 and/or the duct 300 can be coupled directly to the opening 106 of the wall 102*c* on one end, and directly to the opening 212 in the complex curve interior flow surface 200 on the other end, as shown in the example in FIG. 9. In other examples, one or more intervening parts (e.g., ducts, fan casings, or other air flow guiding components, etc.) can be provided between the dual direction flow blower/fan 900 and/or the duct 300 and the opening 106 of the wall 102*c* or the opening 212 in the complex curve interior flow surface 200.

In this example, the dual direction flow blower/fan 900 is integrated into the duct 300 (e.g., bi-directional duct) in an in-line arrangement with the duct 300 and an axis of the opening 106 of the housing 102 and an axis of the opening 212 of the opening 212 of the complex curve interior flow surface 200. In other examples, the dual direction flow blower/fan 900 and/or duct 300, can be angled with respect to the wall 102*c* of the housing 102 and/or with respect to an axis of either the opening 106 of the housing 102 or the opening 212 of the opening 212 of the complex curve interior flow surface 200.

In this example, a complex curve interior flow surface 200 is provided and configured to provide clearance or space within the housing 102 for the duct 300 (e.g., bi-directional duct) and/or the dual direction flow blower/fan 900, as well as for other components, such as one or more control systems and/or sensors (schematically illustrated by 600), while at the same time efficiently conveying the one or more air flows (e.g., A10 and A20) through the housing 102 of the ventilation appliance 100.

Figure 10:
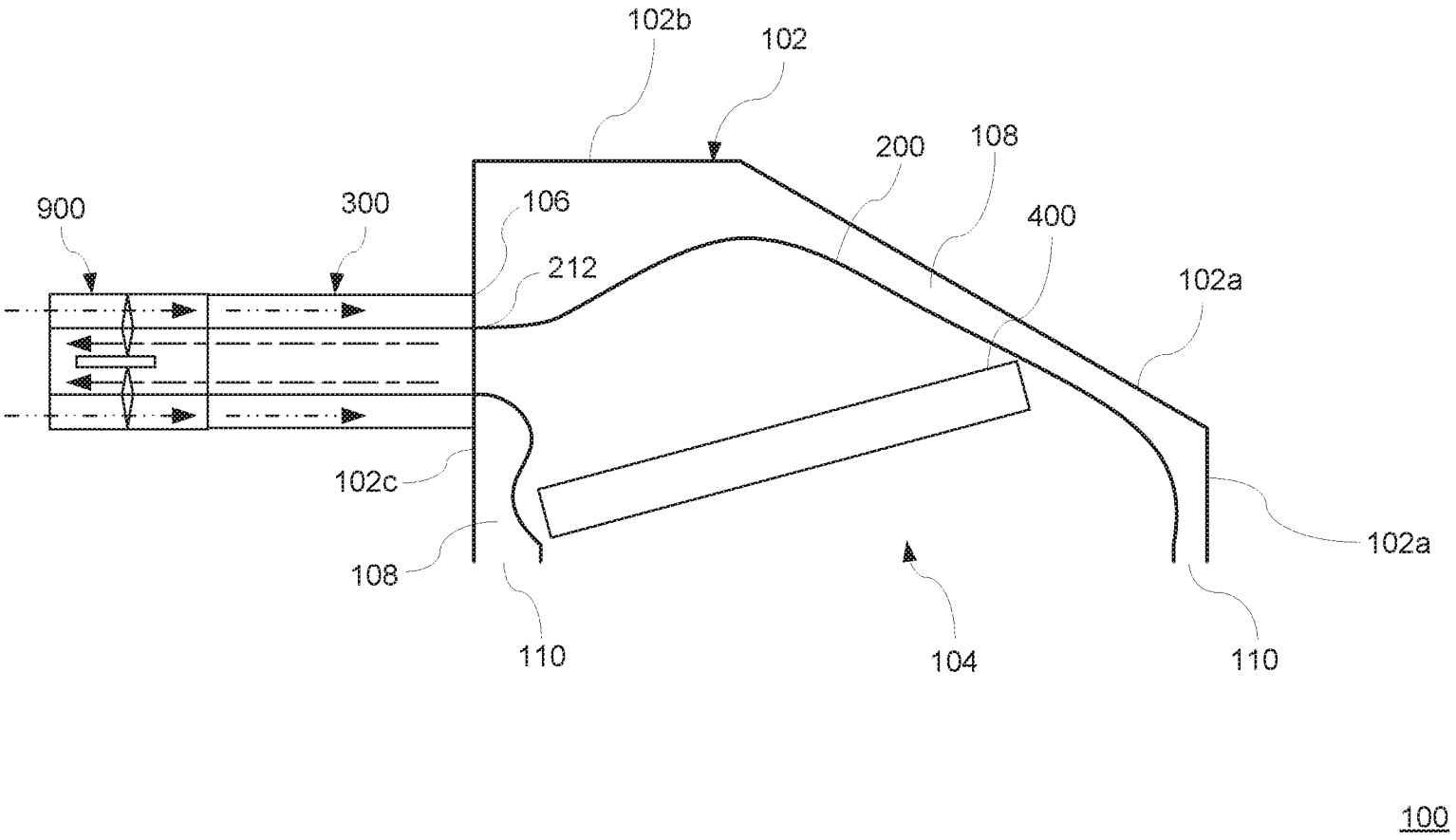
FIG. 10 is a schematic cutaway view of the cooktop ventilation appliance or system according to other exemplary embodiments.

FIG. 10 illustrates an example of a ventilation appliance 100 in which a dual direction flow blower/fan 900 is arranged outside the housing 102 of the ventilation appliance 100. In this example, the dual direction flow blower/fan 900 is separately formed from a bi-directional duct 300 and is coupled to an end of the duct 300 to convey air flows A10 and A20 within the respective inner and outer walls 302 and 304 of the duct 300. In other examples, one or more intervening parts (e.g., ducts, fan casings, or other air flow guiding components, etc.) can be provided between the dual direction flow blower/fan 900 and the duct 300, or the dual direction flow blower/fan 900 can be located remote from the duct 300 and appliance 100, such as in a common or shared supply/exhaust duct for more than one appliance.

In this example, the dual direction flow blower/fan 900 is arranged in an in-line arrangement with the duct 300, as well as with an axis of the opening 106 of the housing 102 and an axis of the opening 212 of the opening 212 of the complex curve interior flow surface 200. In other examples, the dual direction flow blower/fan 900 can be angled with respect to the duct 300, the wall 102*c* of the housing 102, and/or with respect to an axis of either the opening 106 of the housing 102 or the opening 212 of the opening 212 of the complex curve interior flow surface 200.

Figure 11:
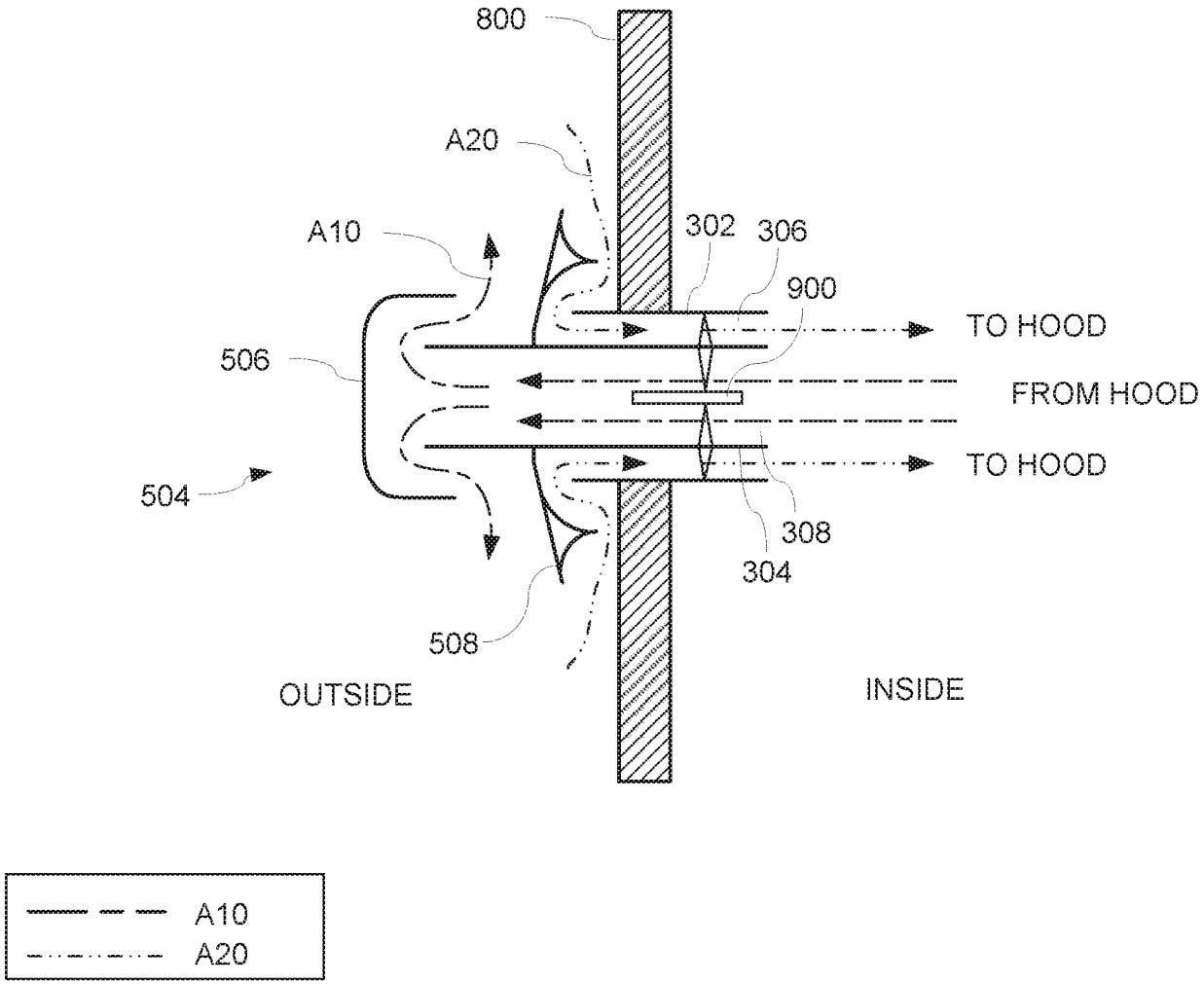
FIG. 11 is a schematic side view of an airflow source and exhaust element of the cooktop ventilation appliance or system according to another exemplary embodiment.

FIG. 11 shows an example of another source, such as a cap system 504 (e.g., bi-directional cap system), for supplying the air A20 to the ventilation appliance 100. In this example, the walls 302 and 304 of the bi-directional duct 300 pass through an exterior wall 800, which separates an inside of a home from the outside of the home. The inner wall 304 can extend farther than the outer wall 302. The example includes a cap 504 at an end of the inner wall 304. The cap 506 is configured to permit the exhaust air A10 to exit the flow path 308 defined by the inner wall 304 of the duct 300 and be exhausted to the outside environment of the home. In this example, the outer wall 302 is configured to permit outside air A20 to be drawn into the flow path 306 defined between the outer wall 302 and the inner wall 304 of the duct 300 and conveyed to the interior of the housing 102 of the ventilation appliance 100 (i.e., the kitchen ventilation appliance or hood). The cap system 504 (e.g., bi-directional cap system) includes a deflector or divider 508 extending outward (e.g., radially outward) from the inner wall 304. The deflector or divider 508 can guide the outside air A20 to be drawn into the flow path 306 and/or guide the exhaust air A10 exiting the flow path 308 to the outside environment. The outer wall 302 of the duct 300 can be coupled, directly or indirectly, to the opening 106 of the wall 102*c* of the housing 102 such that both flow paths 306 and 308 are in communication with the interior of the housing 102 through the same opening 106.

In this example, a dual direction flow blower/fan 900 is integrated into the duct 300 (e.g., bi-directional duct) in an in-line arrangement with the bi-directional duct 300. In other examples, the dual direction flow blower/fan 900 can be angled with respect to the duct 300, the wall 800, etc. The dual direction flow blower/fan 900 is configured to convey exhaust air A10 along the first flow path 308 through the duct 300, for exhausting the exhaust air A10 to the outside. At the same time, the dual direction flow blower/fan 900 is configured to convey secondary air A20 (e.g., make-up air, outside air, cool air, etc.) from the outside along the second flow path 306 through the duct 300 and into the opening 106 in the wall 102*c* of the housing 102 of the ventilation appliance 100.

The invention is not limited to any arrangement or configuration illustrated in the examples herein, and one or more features of the housing 102, the duct 300, dual direction flow blower/fan 900, one or more control systems and/or sensors (schematically illustrated by 600), and complex curve interior flow surface 200 in each example can be provided alone or in combination with one or more features of the other examples described herein.

Figure 12:
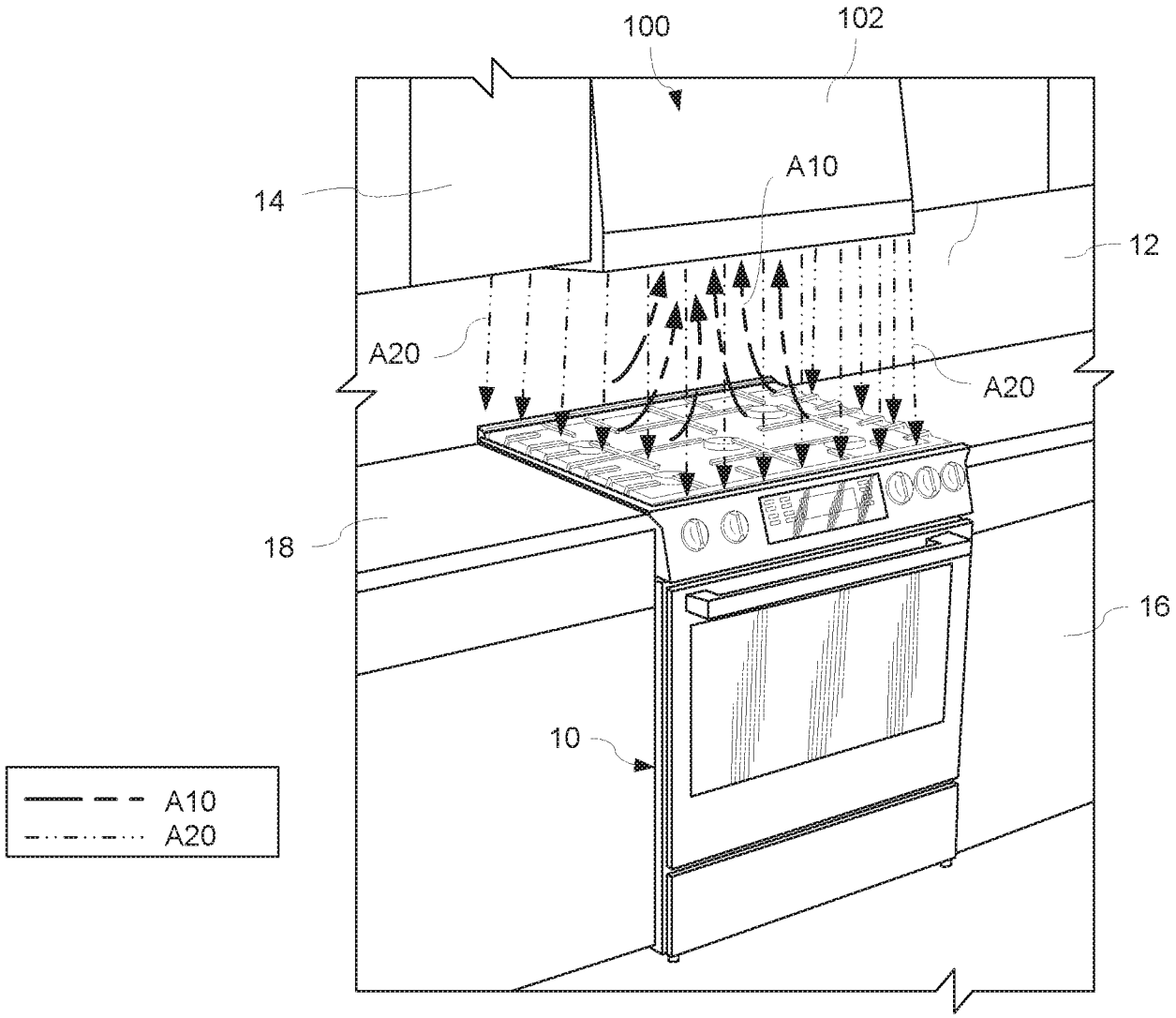
FIG. 12 is a front perspective view of a domestic kitchen having a cooktop ventilation appliance or system showing air flow examples according to an exemplary embodiment of the invention.

FIG. 12 illustrates an example of a ventilation appliance or system 100 shown in a kitchen and arranged above a domestic home cooking appliance, such as a cooking range 10 having a gas cooktop and an internal heat source such as an oven, at least one of which requires ventilation. The ventilation appliance or system 100 can be mounted on a wall 12 of the kitchen with adjacent cabinetry 14 abutting the appliance 100. The cooking range 10 can be disposed adjacent to floor cabinets 16 and counters 18. Referring again to FIGS. 1-12, the exemplary embodiments of a cooktop ventilation appliance or system 100 can provide an air curtain A20 that enhances the capture ability of the ventilation appliance or system 100, and includes a dual direction flow blower/fan 900, along with other components such as a bi-directional duct 300, complex curve interior flow surface 200, etc., which improve air flow efficiency and operation of the ventilation appliance while providing a compact configuration.

With reference again to the examples illustrated in FIGS. 1-12, an exemplary embodiment of the invention is directed to a cooktop ventilation system for providing ventilation of a domestic cooking appliance (e.g., 10), includes a domestic ventilation appliance (e.g., 100) including housing (e.g., 102) having at least a first opening (e.g., 104) and a second opening (e.g., 110), the first opening (e.g., 104) for capturing exhaust air (e.g., A10) from the domestic cooking appliance (e.g., 10) and the second opening (e.g., 110) for permitting secondary air (e.g., A20) to exit an interior of the housing (e.g., 102) to form an air curtain that enhances a capture ability of the domestic ventilation appliance to capture the exhaust air (e.g., A10), and a dual direction flow blower/fan (e.g., 900) configured both to convey the exhaust air (e.g., A10) through the housing (e.g., 102) from the first opening (e.g., 104) in a first direction and to convey the secondary air (e.g., A20) through the housing (e.g., 102) to the second opening (e.g., 110) in a second direction, the second direction being opposite the first direction.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A domestic ventilation system for providing ventilation of a domestic cooking appliance, comprising:

a domestic ventilation appliance including a housing having at least a first opening and a second opening, the first opening for capturing exhaust air from the domestic cooking appliance and the second opening for permitting secondary air to exit an interior of the housing to form an air curtain that enhances a capture ability of the domestic ventilation appliance to capture the exhaust air;

a dual direction flow blower/fan configured both to convey the exhaust air through the housing from the first opening in a first direction and to convey the secondary air through the housing to the second opening in a second direction, the second direction being opposite the first direction, and a complex curve interior flow surface in the housing of the domestic ventilation appliance, the complex curve interior flow surface partitioning the interior of the housing for separately guiding the secondary air and the exhaust air through the housing, a first side of the complex curve interior flow surface configured to guide and smooth a flow of the secondary air conveyed by the dual direction flow blower/fan through the housing to the second opening.

2. The domestic ventilation system of claim 1, wherein the dual direction flow blower/fan is disposed in the interior of the housing of the domestic ventilation appliance.

3. The domestic ventilation system of claim 1, wherein the dual direction flow blower/fan is disposed outside of the housing of the domestic ventilation appliance.

4. The domestic ventilation system of claim 1, wherein the dual direction flow blower/fan includes a bi-directional axial flow fan having at least a first fan section and a second fan section, the first fan section configured to convey the exhaust air in the first direction and the second fan section configured to convey the secondary air in the second direction.

5. The domestic ventilation system of claim 1, wherein the dual direction flow blower/fan includes a fan shaft, and wherein the first fan section and the second fan section are coaxially arranged with and simultaneously driven by the fan shaft.

6. The domestic ventilation system of claim 1, wherein the dual direction flow blower/fan is configured to convey both the secondary air into the interior of the housing and to convey the exhaust air from the interior of the housing through a third opening in the housing.

7. The domestic ventilation system of claim 6, further comprising: a bi-directional duct in fluid communication with the third opening of the housing of the domestic ventilation appliance, the bi-direction duct configured to convey the exhaust air in the first direction from the interior of the housing through the third opening of the housing and to convey the secondary air in the second direction through the third opening of the housing into the interior of the housing.

8. The domestic ventilation system of claim 7, wherein the dual direction flow blower/fan is coupled to the bi-directional duct at an opposite end of the bi-directional duct from the housing of the domestic ventilation appliance.

9. The domestic ventilation system of claim 7, wherein the dual direction flow blower/fan is integrally formed within the bi-directional duct.

10. The domestic ventilation system of claim 7, wherein the bi-directional duct includes:

an outer wall; and an inner wall nested within the outer wall, the inner wall defining a first flow path configured to convey the exhaust air supplied by the dual direction flow blower/fan through the bi-directional duct in the first direction, and the outer wall and the inner wall defining a second flow path configured to convey the secondary air supplied by the dual direction flow blower/fan through the bi-directional duct in the second direction.

11. The domestic ventilation system of claim 10, wherein the outer wall and the inner wall are concentric cylindrical walls.

12. The domestic ventilation system of claim 10, wherein the outer wall of the bi-directional duct is coupled to a perimeter of the third opening of the housing of the domestic ventilation appliance.

13. The domestic ventilation system of claim 1, wherein a second side of the complex curve interior flow surface, which is opposite to the first side of the complex curve interior flow surface, is configured to guide and smooth a flow of the exhaust air being conveyed through the housing of the domestic ventilation appliance by the dual direction flow blower/fan.

14. The domestic ventilation system of claim 13, wherein the complex curve interior flow surface includes a body having an opening configured to permit the exhaust air being conveyed in the first direction by the dual direction flow blower/fan to pass through the body.

15. The domestic ventilation system of claim 1, wherein the dual direction flow blower/fan is disposed in the interior of the housing of the domestic ventilation appliance, and the dual direction flow blower/fan conveys the flow of the secondary air on the first side of the complex curve interior flow surface and conveys the flow of the exhaust air on the second side of the complex curve interior flow surface.

16. The domestic ventilation system of claim 14, wherein the dual direction flow blower/fan is disposed in the interior of the housing of the domestic ventilation appliance, and the dual direction flow blower/fan conveys the flow of the secondary air on the first side of the complex curve interior flow surface and conveys the flow of the exhaust air on the second side of the complex curve interior flow surface through the opening in the body of the complex curve interior flow surface.

17. The domestic ventilation system of claim 6, further comprising: a complex curve interior flow surface in the housing of the domestic ventilation appliance, the complex curve interior flow surface partitioning the interior of the housing for separately guiding the secondary air and the exhaust air through the housing, a first side of the complex curve interior flow surface configured to guide and smooth a flow of the secondary air conveyed by the dual direction flow blower/fan from the third opening in the housing through the housing to the second opening.

18. The domestic ventilation system of claim 17, wherein the complex curve interior flow surface includes a body having an opening configured to permit the exhaust air being conveyed in the first direction by the dual direction flow blower/fan to pass through the body to the third opening in the housing.

19. The domestic ventilation system of claim 1, wherein the dual direction flow blower/fan is configured to convey both the secondary air into the interior of the housing and the exhaust air from the interior of the housing through a single, same opening in the housing.

* * * * *